US006305168B1

(12) United States Patent
Furukawa

(10) Patent No.: US 6,305,168 B1
(45) Date of Patent: Oct. 23, 2001

(54) V-TYPE ENGINE WITH TURBOCHARGER

(75) Inventor: Kazunari Furukawa, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/525,639

(22) Filed: Mar. 14, 2000

(30) Foreign Application Priority Data

Mar. 18, 1999 (JP) ..... 11-073908
Mar. 9, 2000 (JP) ..... 12-071054

(51) Int. Cl.[7] ..... F02B 33/44
(52) U.S. Cl. ..... 60/605.1; 123/53.6
(58) Field of Search ..... 60/605.1, 605.3; 123/53.6

(56) References Cited

U.S. PATENT DOCUMENTS 4,372,120 * 2/1983 Ford, Jr. et al. ..... 60/605.1
4,458,491 * 7/1984 Deutschmann ..... 60/605.1 X
5,501,075 * 3/1996 Spies et al. ..... 60/605.1
6,021,746 * 2/2000 Pyon ..... 60/605.1 X

FOREIGN PATENT DOCUMENTS 5-001564 1/1993 (JP) .

* cited by examiner

*Primary Examiner*—Hoang Nguyen
(74) *Attorney, Agent, or Firm*—McCormick, Paulding & Huber LLP

(57) ABSTRACT

A V-type engine having a turbocharger located between two banks, and an oil shield between the turbocharger and a valley of the banks. The oil shield blocks the oil spattered from the interbank valley so that flying of the oil to the turbocharger from the interbank valley is prevented. The oil shield may be an oil shielding plate. The oil shielding plate includes a cover portion covering a lower part of the turbocharger, and a plurality of extensions extending from the cover potion to be mounted on the engine. The cover portion has an oil outlet to allow a leakage oil to escape from the cover portion therethrough. An oil drain is formed in the interbank valley, and the leakage oil collected by the cover portion drops onto the interbank valley from the oil outlet of the cover portion and is subsequently discharged from the engine through the oil drain.

5 Claims, 1 Drawing Sheet

V-TYPE ENGINE WITH TURBOCHARGER

BACKGROUND OF THE INVENTION

1. Field of the Invention

The present invention generally relates to a V-type engine equipped with a turbocharger, and more particularly to such an engine having a turbocharger positioned between two banks of the engine.

2. Description of the Related Art

When a mechanical supercharging device such as a turbocharger is attached to a V-type engine, the turbocharger is often located between two banks of the engine in order to effectively use a space between the banks.

Japanese Patent Application Laid Open Publication No. 5-1564 discloses a V-type engine equipped with a mechanical supercharger situated between banks.

Because a rotor shaft rotates at a very high speed in the mechanical supercharger, it is necessary to feed an oil to bearings of the rotor shaft for lubrication and cooling. In general, an engine oil is used as this lubrication/cooling oil. A pump, oil passages/pipes and the like for recirculating the oil in the engine are also utilized to deliver the oil to the rotor shaft bearings.

Specifically, an oil conduit is branched from a cylinder block, cylinder head or other oil delivery part(s) and extends to an oil inlet of the mechanical supercharger. The oil is then caused to flow to the rotor shaft bearings.

However, if bolts for connecting the oil conduit and mechanical supercharger become loose, or the oil conduit is damaged by solid particles accidentally admitted to the oil conduit, then oil leakage may occur. The leaking oil drops to a valley between the two banks (referred to as "interbank valley").

An oil drain is generally formed in the interbank valley so that the leakage oil is promptly discharged from the engine. In reality, however, some oil unavoidably remains in the interbank valley. For instance, the oil adheres or sticks onto the interbank valley.

In the meantime, a turbocharger (particularly its turbine and associated parts) is sometimes heated to a very high temperature such as about 700 to 800° C. during operation, and vibrations of the engine and vehicle body may cause the oil remaining on the interbank valley to spatter to the mechanical supercharger. This should be avoided.

SUMMARY OF THE INVENTION

An object of the present invention is to prevent an oil from flying to a turbocharger from a bank valley of a V-type engine.

According to one aspect of the present invention, there is provided a V-type engine having a turbocharger located between two banks, characterized in that a shield member is also provided between the turbocharger and the bottom of the interbank valley of the engine. The shield member becomes an obstacle against the oil spattered from the V bank valley so that the spattered oil cannot reach the hot parts of the turbocharger.

The shield member may be a shielding plate. The shielding plate may include a cover portion covering a lower part of the turbocharger, and a plurality of extensions erected (or bent) from the cover potion to be mounted on the engine. The cover portion may have a shallow U shape that generally conforms to the interbank valley. The cover portion may have an oil outlet to allow a leakage oil to escape from the cover portion therethrough and to drop onto the interbank valley. The oil outlet may be a cutout formed in the cover portion, with a front end of the cutout being open.

A plurality of bosses may be formed on inside (or inwardly facing) walls of the banks whereby the extensions of the cover portion are placeable on these bosses and screwed when the shielding plate is fixed to the engine. The extensions may have holes through which bolts can extend, and the bosses may have internal threads.

A plurality of fingers may extend from lateral edges of the cover portion in such a way that the fingers cover part of the inside walls of the banks.

An oil drain may be formed in the interbank valley, and leakage oil collected by the cover portion may be allowed to drop onto the interbank valley from the oil outlet of the cover portion and be subsequently discharged from the engine.

The shielding plate may also serve as a vibration damping steel plate. The vibration damping steel plate may include a pair of steel plates and a vibration damping material sandwiched between the steel plates with adhesive. The vibration damping material may be a thermoplastic viscoelastic resin. The vibration damping material may contain inorganic fibers such as ceramics, carbon and glass.

DETAILED DESCRIPTION OF THE INVENTION

Figure 1:
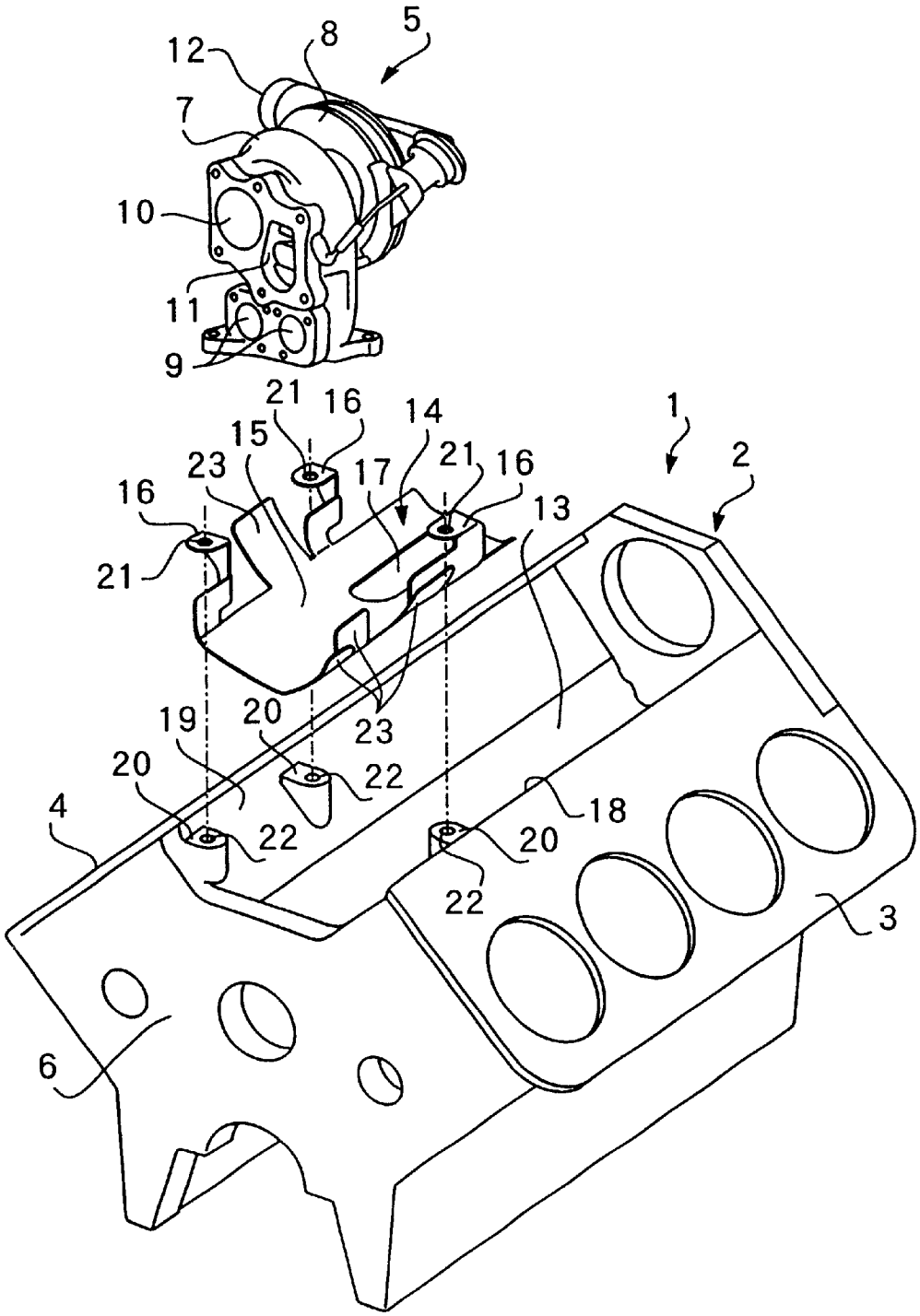
FIG. 1 illustrates an exploded perspective view of major parts of a V-type engine according to the present and associated parts.

Now, an embodiment of the present invention will be described in reference to the accompanying drawing.

Referring to FIG. 1, illustrated is an engine 1 having a cylinder block 2 with a pair of banks, namely a left bank 3 and right bank 4. A turbocharger 5 is located between the banks 3 and 4. The turbocharger 5 is relatively close to a rear end 6 of the engine 1. The turbocharger 5 includes a turbine 7, compressor 8, exhaust gas inlets 9, exhaust gas outlet 10, exhaust gas bypass outlet 11 and intake air inlet 12. The turbocharger 5 is mounted in such a manner that a center axis of a rotor shaft is parallel to a center axis of a crankshaft of the engine 1. The exhaust gas inlets 9 and outlet 10 are directed toward the rear.

Between the turbocharger 5 and a bottom 13 of a valley between the two banks 3, 4, provided is an oil shield i.e., oil shielding plate 14. The oil shielding plate 14 may be any common metallic plate, but in this particular embodiment it is a vibration-absorbing steel plate. The oil shielding plate 14 is a one-piece plate and includes a cover portion 15 covering a lower part of the turbocharger 5 and three flanges 16 erected (or bent) from the cover portion 15. The flanges 16 extend from left and right lateral edges of the cover portion 15.

The cover portion 15 has a rectangular shape elongated in a longitudinal direction of the engine (or crankshaft direction), and its cross section when cut in a direction perpendicular to the crankshaft direction has a shallow U shape which fits the shape of the interbank valley bottom 13. The cover portion 15 also has a cutout section 17 that extends from a front end of the cover portion to the approximate middle. The cutout 17 has a generally oval shape elongated in the crankshaft direction, and its front end is open. This cutout 17 serves as an oil outlet (will be described).

Three bosses 20 are formed on inside walls 18, 19 of the banks 3, 4 of the engine 1. The three flanges 16 of the oil shielding plate 14 are plated on these bosses 20 respectively when the oil shielding plate 14 is fixed to the engine 1. Each of the flanges 16 has a through hole 21 for a bolt, and each of the bosses 20 has a female thread 22. Three bolts (not shown) are tightened when the oil shielding plate 14 is mounted on the engine 1. Preferably, the bosses 20 may also be used to mount other parts of the engine 1. In such a case, the oil shielding plate 14 may be mounted together with such parts.

The cover portion 15 also has a plurality of fingers 23 extending from the left and right edges of the cover portion 15 in the vicinity of the mounting flanges 16. These fingers 23 extend over part of the inside walls 18, 19 of the banks 3, 4. An oil drain port (not shown) is formed in the interbank valley bottom 13 such that an oil collected in the valley 13 is discharged from the engine. An oil conduit (not shown) is also connected to the turbocharger 5 to feed an oil to shaft bearings in the turbocharger 5.

When connection or joint of the oil conduit becomes loose, or the oil conduit is damaged, the oil will leak from the oil conduit. This leakage oil is collected to the cover portion 15 of the oil shielding plate 14, and then allowed to drop to the interbank valley 13 from the cutout 17 of the cover portion 15. Subsequently, the leakage oil is discharged from the oil drain portion of the interbank valley 13 as mentioned above.

Since the oil shielding plate (shielding member) 14 exists between the turbocharger 5 and interbank valley 13, the oil existing on the interbank valley 13 does not reach the turbocharger 5 (particularly the turbine 7) even if it is spattered upon vibrations of the engine and vehicle body. The spattered oil is blocked by the shielding plate 14. The turbocharger 5 sometimes becomes very hot during operation, but the leakage oil in the interbank alley 13 is prevented from flying to the turbocharger 5.

The cover portion 15 has a shallow U shape like a dish and also possesses the cutout 17 in such a manner that the leakage oil collected on the cover portion 15 is guided to a distal area from the turbocharger 5 and the leakage oil smoothly and quickly drops onto the interbank valley 13. The leakage oil does not therefore stay on the cover potion 15. The cover portion 15 may be inclined to a certain extent to facilitate movement of the leakage oil on the cover portion 15.

In the meanwhile, membrane vibration may occur in the oil shielding plate 14 due to engine vibration since a V-type engine tends to "close" and "open" during operation. In this case, there is a possibility that the oil shielding plate 14 itself becomes a vibration source. In consideration of such possibility, the oil shielding plate 14 is made of vibration-resistive or damping steel plate in this embodiment. Consequently, the oil shielding plate 14 absorbs vibration energy transmitted to the oil shielding plate from the engine 1 (or cylinder block 2) and does not vibrate. The vibration damping steel plate generally includes a damping material such as thermoplastic viscoelastic resin of 0.05 to 0.2 mm thickness, sandwiched by two steel plates with adhesive. Any vibration damping steel which can stand under the temperature of 800° C. may be employed in this embodiment. The damping material may contain inorganic fiber such as ceramics, carbon and/or glass.

It should be noted that the shielding member 14 of the invention is provided primarily for shielding between the turbocharger and interbank valley, not for protection of the turbocharger from vibration of the engine banks 3, 4. Therefore, the oil shielding plate 14 of the illustrated embodiment is thin and light and has a relatively simple structure. This feature distinguishes the invention from the bracket disclosed in Japanese Patent Application Laid Open Publication No. 5-1564 introduced earlier. The bracket of this prior art is provided for supporting the turbocharger and for protecting the turbocharger from the vibration of the engine. In other words, the bracket should be thick and heavy. Accordingly, the conventional bracket occupies a relatively large space in the interbank valley and affects arrangement of other engine parts. The shielding member of the invention, on the other hand, has a good layout property so that it does not adversely affect arrangement of other engine parts.

It should be noted that the present invention is not limited to the illustrated and described embodiment. For example, the shielding member 14 and oil outlet 17 may have different contours and take other positions respectively. Specifically, the item 17 may be one or more through holes, instead of cutout. The engine 1 may be either a gasoline engine or diesel engine.

The above described V-type engine with a turbocharger is disclosed in Japanese Patent Application Nos. 11-73908 and 2000-71054 filed on Mar. 18, 1999 and Mar. 9, 2000 respectively, the instant application claims priority of these Japanese Patent Applications, and the entire disclosures thereof are incorporated herein by reference.

What is claimed is:

1. A V-type engine having two banks and defining an interbank valley between the two banks, comprising:

a turbocharger located between the two banks; and a shielding member situated between the turbocharger and the bottom of the interbank valley, the shielding member being a shielding plate which includes a cover portion to cover a lower part of the turbocharger and a plurality of extensions erected from the cover portion to be mounted onto the engine.

2. The V-type engine according to claim 1, wherein the cover portion has a shallow U shape that generally conforms to the interbank valley.

3. A V-type engine having two banks and defining an interbank valley between the two banks, comprising:

a turbocharger located between the two banks; and a shielding member situated between the turbocharger and the bottom of the interbank valley, the shielding member being a shielding plate including a cover portion to cover a lower part of the turbocharger, and the cover portion having an oil outlet to allow an oil to escape from the cover portion therethrough.

4. The V-type engine according to claim 1, wherein the shielding plate is made from a vibration damping steel plate.

5. The V-type engine according to claim 4, wherein the vibration damping steel plate includes a pair of steel plates and a vibration damping material sandwiched between the pair of steel plates with adhesive.

* * * * *